US010932050B2

(12) United States Patent
Song et al.

(10) Patent No.: US 10,932,050 B2
(45) Date of Patent: Feb. 23, 2021

(54) MICRO-SPEAKER

(71) Applicant: AAC Technologies Pte. Ltd., Singapore (SG)

(72) Inventors: Wei Song, Shenzhen (CN); Yunhu Nie, Shenzhen (CN); Zhiwei Zhong, Shenzhen (CN); Weiwei Tao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,726

(22) Filed: Dec. 7, 2019

(65) Prior Publication Data

US 2020/0213746 A1 Jul. 2, 2020

(30) Foreign Application Priority Data

Dec. 31, 2018 (CN) ..... 201822278393.9

(51) Int. Cl.

| | |
|---|---|
| ***H04R 9/00*** | (2006.01) |
| ***H04R 9/02*** | (2006.01) |
| ***H04R 9/04*** | (2006.01) |
| ***H04R 7/12*** | (2006.01) |
| ***H04R 7/16*** | (2006.01) |

(52) U.S. Cl.

CPC ..... *H04R 9/025* (2013.01); *H04R 7/127* (2013.01); *H04R 7/16* (2013.01); *H04R 9/045* (2013.01)

(58) Field of Classification Search

CPC .... H04R 9/00; H04R 29/003; H04R 2209/00; H04R 2209/41; H04R 9/025; H04R 9/027

USPC ..... 381/396, 400, 412, 433

See application file for complete search history.

(56) References Cited

U.S. PATENT DOCUMENTS

| | | | | |
|---|---|---|---|---|
| 7,272,237 | B2 * | 9/2007 | Linn | H04R 9/06 381/396 |
| 8,139,811 | B2 * | 3/2012 | Itoh | H04R 9/02 381/396 |
| 8,358,801 | B2 * | 1/2013 | Vincent | H04R 9/06 381/396 |
| 2007/0269076 | A1 * | 11/2007 | Honda | H04R 9/00 381/411 |
| 2012/0207339 | A1 * | 8/2012 | Babb | H04R 9/022 381/400 |
| 2013/0070955 | A1 * | 3/2013 | Holt | H04R 9/025 381/412 |

* cited by examiner

*Primary Examiner* — Suhan Ni
(74) *Attorney, Agent, or Firm* — W&G Law Group LLP

(57) ABSTRACT

A micro-speaker includes a vibration unit including a diaphragm assembly and a voice coil assembly, a magnetic circuit unit including a yoke including a voice coil bobbin and a voice coil affixed to the voice coil bobbin, and a magnet provided on the yoke, and a holder including a holder bottom wall abutting against the yoke, a holder sidewall extending from a side of the holder bottom wall close to the magnet along a direction facing away from the yoke and forming a magnetic gap with the magnet in which the voice coil is disposed, and a magnetism shielding wall formed by extending from a side of the holder sidewall facing away from the yoke while being bent towards the voice coil, a side of the magnetism shielding wall facing away from the diaphragm being provided with a hollow annular magnetic conductive sheet spaced apart from the voice coil.

10 Claims, 3 Drawing Sheets

MICRO-SPEAKER

TECHNICAL FIELD

The present disclosure relates to the technical field of sounding apparatus, and in particular, to a micro-speaker.

BACKGROUND

In order to adapt to miniaturization and multi-functionality development of various audio apparatuses and information communication apparatuses, micro-speakers used in the above apparatuses also need to be miniaturized so as to be more compact with other sounding components. Especially with lightness and thinness development of mobile phones, the micro-speakers used in the mobile phones not only require miniaturization but also demand for high-quality sound and stereo, etc., while a vibration unit and a magnetic circuit unit used in the micro-speaker are directly related to sound quality of the micro-speaker. The micro-speaker in the related art includes a holder, and a vibration unit and a magnetic circuit unit that are fixed to the holder. The vibration unit includes a diaphragm and a voice coil affixed to the diaphragm; the magnetic circuit unit includes a yoke and a magnet disposed in the yoke.

It is found that at least following problems exist in the related art: in order to ensure a magnetic conductive effect of the micro-speaker, the holder needs to be punching-formed by using a relatively thick steel sheet, and a production cost is high.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
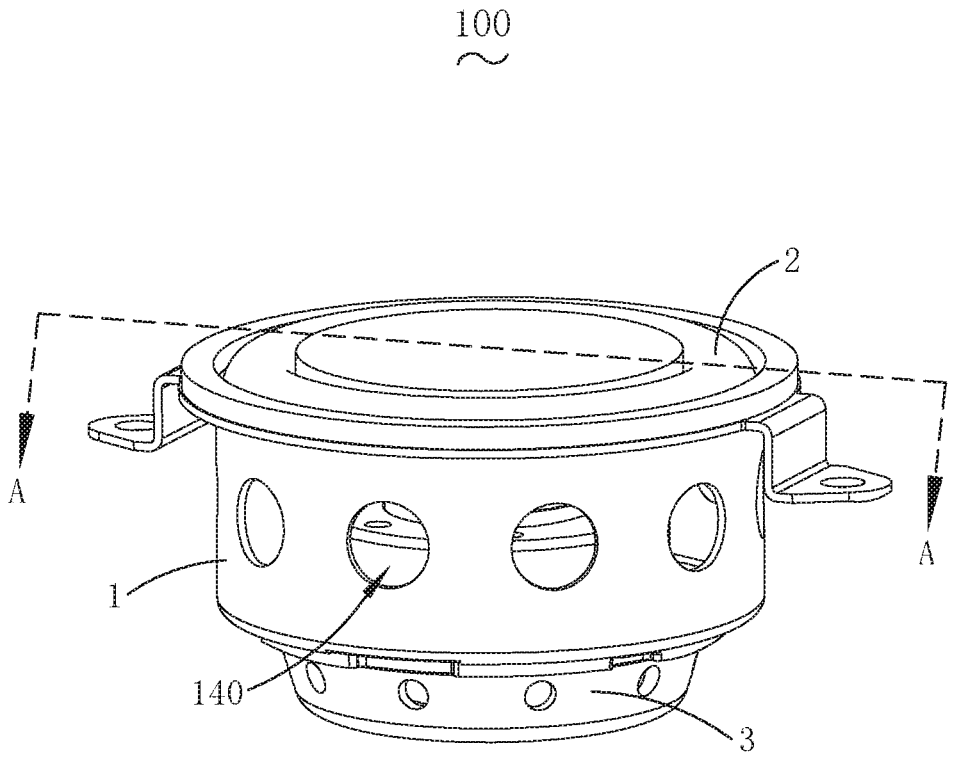
FIG. 1 is a perspective structural diagram of a micro-speaker provided by an embodiment of the present disclosure.
Figure 2:
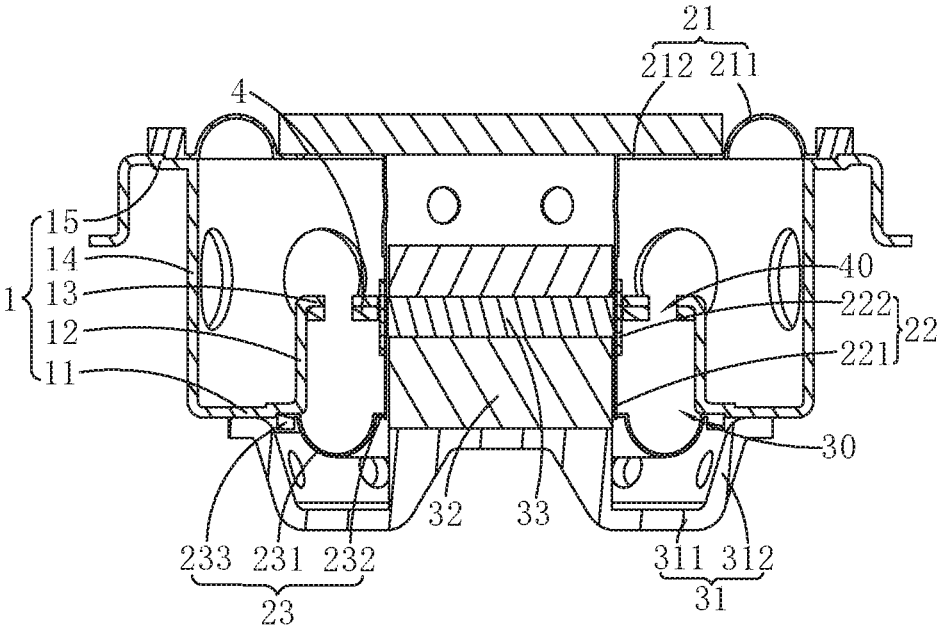
FIG. 2 is a cross-sectional diagram taken along line AA' of FIG. 1.

An embodiment of the present disclosure relates to a micro-speaker 100. As shown in FIG. 1 and FIG. 2, the micro-speaker 100 includes: a holder 1, a vibration unit 2, and a magnetic circuit unit 3, the vibration unit 2 and the magnetic circuit unit 3 being fixed on the holder 1. The vibration unit 2 includes a diaphragm assembly 21 and a voice coil assembly 22 interconnected with the diaphragm assembly 21. The voice coil assembly 22 includes a voice coil bobbin 221 interconnected with the diaphragm assembly 21 and a voice coil 222 affixed to the voice coil bobbin. The magnetic circuit unit 3 includes a yoke 31 buckled on the holder 1 and a magnet 32 affixed to the yoke 31. The holder 1 includes a holder bottom wall 11 that abuts against the yoke 31, a holder sidewall 12 extending from a side of the holder bottom wall 11 close to the magnet 32 along a direction facing away from the yoke 31, a magnetism shielding wall 13 formed by extending from a side of the holder sidewall 12 facing away from the yoke 31 while being bent towards the voice coil 22, a holder outer wall 14 extending from a side of the holder bottom wall 11 facing away from the magnet 32 along a direction facing away from the yoke 31, and a holder top wall 15 extending outward from an end of the holder outer wall 14 facing away from the yoke 31. The holder sidewall 12 forms a magnetic gap 30 with the magnet 32, and the voice coil 22 is disposed in the magnetic gap 30. A side of the magnetism shielding wall 13 facing away from the diaphragm assembly 21 is provided with a hollow annular magnetic conductive sheet 4. The magnetic conductive sheet 4 is spaced apart from the voice coil 22.

Compared with the related art, in the embodiment of the present disclosure, the holder 1 includes the magnetism shielding wall 13 that is formed by extending from the side of the holder sidewall 12 facing away from the yoke 31 while being bent towards the voice coil 22, and the provision of the magnetism shielding wall 13 can prevent magnetic force lines in the magnetic gap 30 from leaking, thereby relatively increasing a driving force of the magnetic circuit unit 3; the magnetic conductive sheet 4 is provided on the side of the magnetism shielding wall 13 facing away from the diaphragm 21, which can increase the magnetic conductive performance of the micro-speaker 100, such that the magnetic conductive performance of the micro-speaker 100 can still be ensured even in the case where the holder 1 is stamping-formed by using a relatively thin steel sheet, so as to reduce a production cost of the micro-speaker 100, thereby avoiding the case where "in order to ensure a magnetic conductive effect of the micro-speaker, the holder needs to be stamping-formed by using a relatively thick steel sheet, and the production cost is high".

In an embodiment, the yoke 31 includes a yoke bottom wall 311 and a yoke sidewall 312 that is formed by extending and bending the yoke bottom wall 311. The yoke sidewall 312 abuts against the holder bottom wall 11. A tip end of the yoke sidewall 312 facing away from the yoke bottom wall 311 extends a certain length along a direction facing away from the magnet 32, and the extension abuts against the holder bottom wall 11. In this way, a contact area between the yoke sidewall 312 and the holder bottom wall 11 can be increased, so that the magnetic circuit unit 3 is more stably fixed to the holder 1.

It can be understood that the magnetic conductive sheet 4 has a hollow annular shape. It can be seen from FIG. 2 that a size of the annular space of the magnetic conductive sheet 4 is equal to a size of an annular space enclosed by the magnetism shielding wall 13, and an inner edge surface of the magnetic conductive sheet 4 is flush with an inner edge surface of the magnetism shielding wall 13.

Figure 3:
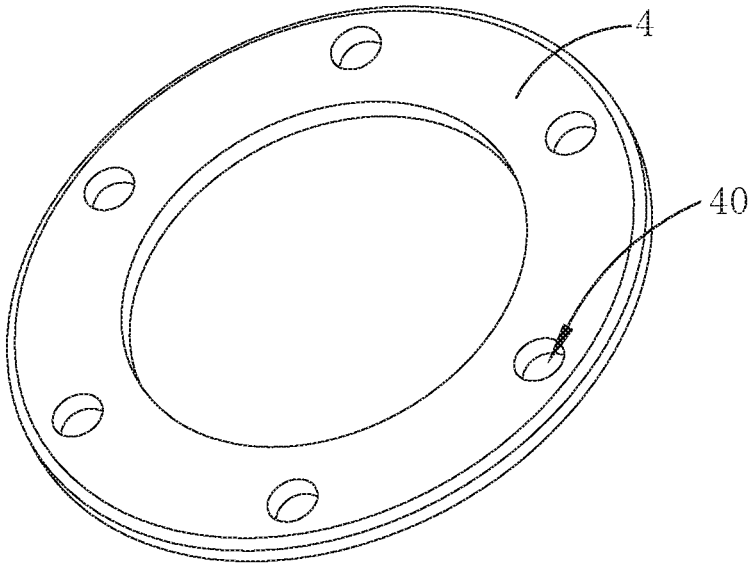
FIG. 3 is a structural schematic diagram of a magnetic conductive sheet according to an embodiment of the present disclosure.

In an embodiment, as shown in FIG. 3, the magnetic conductive sheet 4 is provided with a circular through hole 40. In an embodiment, a plurality of circular through holes 40 are provided, and the plurality of circular through holes 40 is equally spaced in a circumferential direction.

The diaphragm assembly 21 includes a diaphragm 212 and a dome 211 affixed to the diaphragm 212, and the voice coil bobbin 221 is fixedly connected to the diaphragm 212.

In an embodiment, the vibration unit 2 further includes a support portion 23 fixed to an end of the voice coil 22 facing away from the diaphragm 212, and the support portion 23 is arranged in the magnetic gap 30. The diaphragm assembly 21 and the support portion 23 form a double-support structure for fixedly supporting the voice coil 22. This double-support structure greatly avoids an unbalanced vibration of the vibration unit 2 during an operation of the micro-speaker 100, thereby improving the stability of the micro-speaker 100, and further increases the power of the micro-speaker 100, so that the micro-speaker 100 has better acoustic performance.

In an embodiment, the support portion 23 includes a recessed portion 231, and a first fixing portion 232 and a second fixing portion 233, and the first fixing portion 232 and the second fixing portion 233 are formed by extending from two sides of the recessed portion 231 while being bent, respectively. The first fixing portion 232 is fixed to an end of the voice coil 22 facing away from the diaphragm 21, and the second fixing portion 233 is fixed to the holder bottom wall 11. As shown in FIG. 1, the recessed portion 231 is recessed away from the diaphragm 21, and the provision of the recessed portion 231 can increase elasticity of the support portion 23 so that the support portion 23 can better support the voice coil 22. Without doubt, a direction in which the recessed portion 231 is recessed is not limited thereto, and the recessed portion 231 may be otherwise recessed towards the diaphragm 21, but the principle is the same.

It should be noted that, in an embodiment, the magnetic gap 30 between the magnet 32 and the holder sidewall 12 can be made wider, which can prevent noise generated by colliding of the support portion 23 with the holder sidewall 12 when vibrating. Moreover, due to the provision of the magnetism shielding wall 13, magnetism leakage that weakens a driving force of the magnetic circuit unit 3 will not occur, even if the magnetic gap 30 is made wider.

In a further embodiment, the magnetic circuit unit 3 of the micro-speaker 100 further includes a pole plate 33 affixed to the magnet 32, and the pole plate 33 is spaced apart from the voice coil bobbin 221. The pole plate 33 can better conduct the magnetism and increase the driving force of the magnetic circuit unit 3, thereby making the acoustic performance of the micro-speaker 100 superior.

In an embodiment, the holder outer wall 14 is provided with a circular hole 140. The diaphragm assembly 21 is fixedly connected to the holder top wall 15.

What has been described above are merely embodiments of the present disclosure, and it should be noted herein that one ordinary person skilled in the art can make improvements without departing from the inventive concept of the present disclosure, but these are all within the scope of the present disclosure.

What is claimed is:

1. A micro-speaker, comprising:

a holder;

a vibration unit fixed at the holder; and a magnetic circuit unit fixed at the holder, wherein the vibration unit comprises a diaphragm assembly and a voice coil assembly that are connected to each other, and the voice coil assembly comprises a voice coil bobbin connected to the diaphragm assembly and a voice coil affixed to the voice coil bobbin; and the magnetic circuit unit comprises a yoke buckled on the holder and a magnet affixed to the yoke, wherein the holder comprises a holder bottom wall abutting against the yoke, a holder sidewall extending from a side of the holder bottom wall close to the magnet along a direction facing away from the yoke, a magnetism shielding wall formed by extending from a side of the holder sidewall facing away from the yoke while being bent towards the voice coil, a holder outer wall extending from a side of the holder bottom wall facing away from the magnet along a direction facing away from the yoke, and a holder top wall extending outward from an end of the holder outer wall facing away from the yoke; the holder sidewall forms a magnetic gap with the magnet, the voice coil is disposed in the magnetic gap, and a magnetic conductive sheet that is hollow and annular and spaced apart from the voice coil is provided at a side of the magnetism shielding wall facing away from the diaphragm assembly.

2. The micro-speaker as described in claim 1, wherein the yoke comprises a yoke bottom wall and a yoke sidewall that is formed by extending and bending the yoke bottom wall, and the yoke sidewall abuts against the holder bottom wall.

3. The micro-speaker as described in claim 2, wherein the magnetic conductive sheet is provided with at least one circular through hole.

4. The micro-speaker as described in claim 3, wherein the at least one circular through hole comprises a plurality of circular through holes, and the plurality of circular through holes is evenly spaced in a circumferential direction.

5. The micro-speaker as described in claim 1, wherein the diaphragm assembly comprises a diaphragm and a dome affixed to the diaphragm, and the voice coil bobbin is fixedly connected to the diaphragm.

6. The micro-speaker as described in claim 5, wherein the magnetic circuit unit further comprises a pole plate affixed to the magnet, and the pole plate is spaced apart from the voice coil bobbin.

7. The micro-speaker as described in claim 1, wherein the vibration unit further comprises a support portion fixed to an end of the voice coil bobbin facing away from the diaphragm assembly, and the support portion is arranged in the magnetic gap.

8. The micro-speaker as described in claim 7, wherein the support portion comprises a recessed portion, a first fixing portion and a second fixing portion, the first fixing portion and a second fixing portion being formed by respectively extending from two sides of the recessed portion while being bent, the first fixing portion is fixed to one end of the voice coil bobbin facing away from the diaphragm assembly, and the second fixing portion is fixed on the holder bottom wall.

9. The micro-speaker as described in claim 1, wherein the holder outer wall is provided with a circular hole.

10. The micro-speaker as described in claim 1, wherein the diaphragm assembly is fixedly connected to the holder top wall.

* * * * *